US009132687B2

(12) United States Patent
Brudermann et al.

(10) Patent No.: US 9,132,687 B2
(45) Date of Patent: Sep. 15, 2015

(54) DOCTOR BLADE

(75) Inventors: Hans Jörg Brudermann, Zollikofen (CH); Sibylle Stiltz, Lotzwil (CH); Andreas Hügli, Heimiswil (CH)

(73) Assignee: Daetwyler SwissTec AG, Bleienbach (CH)

( * ) Notice: Subject to any disclaimer, the term of this patent is extended or adjusted under 35 U.S.C. 154(b) by 495 days.

(21) Appl. No.: 13/522,539

(22) PCT Filed: Jan. 20, 2010

(86) PCT No.: PCT/CH2010/000014

§ 371 (c)(1),
(2), (4) Date: Oct. 8, 2012

(87) PCT Pub. No.: WO2011/088583

PCT Pub. Date: Jul. 28, 2011

(65) Prior Publication Data

US 2013/0014656 A1 Jan. 17, 2013

(51) Int. Cl.

| | |
|---|---|
| ***B41F 9/10*** | (2006.01) |
| ***B41N 10/00*** | (2006.01) |
| ***B05C 11/04*** | (2006.01) |
| ***B41F 31/04*** | (2006.01) |

(52) U.S. Cl.

CPC ..... *B41N 10/005* (2013.01); *B05C 11/045* (2013.01); *B41F 9/1072* (2013.01); *B41F 31/04* (2013.01)

(58) Field of Classification Search

CPC ..... B41F 9/1072

USPC ..... 101/157

See application file for complete search history.

(56) References Cited

U.S. PATENT DOCUMENTS

| | | | | |
|---|---|---|---|---|
| 4,108,740 | A * | 8/1978 | Wearmouth | 101/348 |
| 6,155,167 | A * | 12/2000 | Meyer | 101/157 |
| 6,305,282 | B1 * | 10/2001 | Datwyler | 101/169 |
| 6,841,264 | B2 | 1/2005 | Lunnerfjord et al. | |
| 7,152,526 | B2 | 12/2006 | Urata et al. | |
| 7,201,972 | B2 * | 4/2007 | Shiozaki et al. | 428/614 |
| 8,038,751 | B2 | 10/2011 | Starling | |
| 2002/0182437 | A1 * | 12/2002 | Adamou et al. | 428/679 |
| 2004/0137261 | A1 | 7/2004 | Lunnerfjord et al. | |
| 2005/0089706 | A1 | 4/2005 | Urata et al. | |
| 2007/0017392 | A1 * | 1/2007 | Filippini Fantoni et al. | 101/157 |
| 2008/0172951 | A1 | 7/2008 | Starling | |
| 2009/0120355 | A1 | 5/2009 | Urata et al. | |
| 2011/0219971 | A1 | 9/2011 | Brudermann et al. | |
| 2011/0226144 | A1 | 9/2011 | Brudermann et al. | |
| 2012/0094579 | A1 | 4/2012 | Starling | |

FOREIGN PATENT DOCUMENTS

| | | |
|---|---|---|
| CN | 101160212 | 4/2008 |
| JP | 0215978 | 1/1990 |

(Continued)

*Primary Examiner* — Anthony Nguyen

(74) *Attorney, Agent, or Firm* — Jacox, Meckstroth & Jenkins

(57) ABSTRACT

A doctor blade for scraping printing ink from a surface of a printing plate, comprising a flat and elongated main body having a working edge area formed in a longitudinal direction, the working edge area being coated with at least one first coating on the basis of a nickel-phosphorus alloy, and is characterized in that the first coating contains at least one additional component for improving the wear behavior of the doctor blade.

35 Claims, 3 Drawing Sheets

(56) References Cited

FOREIGN PATENT DOCUMENTS

| | | |
|---|---|---|
| JP | 02118080 | 5/1990 |
| JP | 09254356 | 9/1997 |
| JP | 11245670 | 9/1999 |
| JP | 2001277457 | 10/2001 |
| JP | 2001342453 | 12/2001 |
| JP | 2004167902 | 6/2004 |
| JP | 2005169907 | 6/2005 |
| WO | 02/46526 | 6/2002 |
| WO | 03/064157 | 8/2003 |
| WO | 2006/112522 | 10/2006 |
| WO | 2008091939 | 7/2008 |
| WO | 2010/037240 | 4/2010 |
| WO | 2010/040236 | 4/2010 |

* cited by examiner

DOCTOR BLADE

CROSS-REFERENCE TO RELATED APPLICATIONS

This application claims priority to PCT Application No. PCT/CH2010/000014 filed Jan. 20, 2010, which application is incorporated herein by reference and made a part hereof.

BACKGROUND OF THE INVENTION

1. Field of the Invention

The invention relates to a doctor blade, in particular for scraping printing ink from a surface of a printing plate, which comprises a flat and elongated base element having a working edge region formed in a longitudinal direction, where the working edge region is coated with at least a first coating based on a nickel-phosphorus alloy. The invention further relates to a process for producing a doctor blade.

2. Description of the Related Art

Doctor blades are used in the printing industry, especially for scraping excess printing ink from the surfaces of printing cylinders or printing rollers. Particularly in the case of gravure printing and flexographic printing, the quality of the doctor blade has a critical influence on the printing result. Unevennesses or irregularities in the working edges of the doctor blade which are in contact with the printing cylinder lead, for example, to incomplete scraping of the printing ink from the ridges of the printing cylinders. This can result in uncontrolled release of printing ink on the printing carrier.

The working edges of the doctor blade are pressed against the surfaces of the printing cylinders or printing rollers during scraping-off and are moved relative to these. The working edges are therefore, particularly in the case of rotary printing presses, subjected to high mechanical stresses which result in corresponding wear. Doctor blades are therefore basically consumables which have to be replaced periodically.

Doctor blades are usually based on a base element of steel having a specially shaped working edge. To improve the life of the doctor blade its working edges can additionally be provided with coatings or surfacings of metals and/or plastics. Metallic coatings often contain nickel or chromium which are optionally present in admixture or alloyed with other atoms and/or compounds. The nature of the coatings in terms of materials has a critical influence on, in particular, the mechanical and tribological properties of the doctor blade.

WO 2003/064157 (Nihon New Chrome Co. Ltd.), which is equivalent to U.S. Patent Publication 2005/0089706, now issued as U.S. Pat. No. 7,152,526, which applications are incorporated herein by reference and made a part hereof, describes, for example, doctor blades for printing technology which have a first layer of chemical nickel containing particles dispersed therein and a second layer having a low surface energy. The second layer preferably comprises a coating of chemical nickel containing fluorine-based resin particles or a purely organic resin.

However, doctor blades which have been coated in this way are still not fully satisfactory in respect of the life and wear resistance. In addition, it has been found that when such doctor blades are used, uncontrolled streaking can occur, especially in the running-in phase, which is likewise undesirable.

There is therefore still a need for an improved doctor blade which, in particular, has both a longer life and also allows optimal scraping-off.

SUMMARY OF THE INVENTION

It is therefore an object of the invention to provide a doctor blade of the type used in the technical field mentioned at the outset which has improved wear resistance and allows precise scraping-off, in particular of printing ink, during the entire life.

The object is achieved by providing a doctor blade, in particular for scraping printing ink from a surface of a printing plate, which comprises a flat and longitudinal base element having a working edge region formed in a longitudinal direction, where the working edge region is coated with at least a first coating based on a nickel-phosphorus alloy, wherein the first coating contains at least one additive component for improving the wear behavior of the doctor blade, where the at least one additive component comprises hard material particles, wherein the hard material particles comprise both SiC and diamond, with the particle size of the SiC being greater than the particle size of the diamond. According to the invention, the first coating contains at least one additive component for improving the wear behavior of the doctor blade.

For the purposes of the present invention, an additive component for improving the wear behavior of the doctor blade is, in particular, particles dispersed in the first coating and/or chemical substances which have been mixed in.

In the case of an additive component in the form of dispersed particles, the first coating has a heterogeneous structure which, in particular, contains the dispersed particles in the nickel-phosphorus alloy as matrix. Such coatings can also be described as mixtures. The particles are advantageously essentially uniformly distributed in the first coating. The dispersed particles can be, in particular, metals, metal oxides, metal carbides, metal nitrides, metal carbonitrides, metal borides, ceramics and/or intermetallic phases. Suitable materials for the particles are, inter alia, one or more representatives from the group consisting of Al, Cu, Pb, W, Ti, Zr, Zn Cu, Mo, steel, $WSi_2$, $Al_2O_3$, $Cr_2O_3$, $Fe_2O_3$, $TiO_2$, $ZrO_2$, $ThO_2$, $SiO_2$, $CeO_2$, $BeO_2$, MgO, CdO, $UO_2$, SiC, TiC, WC, VC, ZrC, TaC, $Cr_3C_2$, $B_4C$, BN, $ZrB_2$, TiN, $Si_3N_4$, $ZrB_2$ and/or $TiB_2$. However, other, for example completely nonmetallic and/or metal-organic particles are also possible as additive component for improving the wear behavior of the doctor blade. Completely nonmetallic particles can, for example, be present in the form of diamond.

In this context, the particle size is, in particular, a maximum dimension and/or external dimension of the particles. As regards the particle size, the particles generally have a certain distribution or scatter. When particle sizes are referred to in the present context, average particle sizes are, in particular, meant.

Additive components in the form of mixed-in chemical substances are, in particular, present as homogeneous mixtures and/or alloys. The mixed-in chemical substances can be, for example, metals. Examples of metals are, inter alia, Al, Cu, Pb, W, Ti, Zr and/or Zn. However, it is in principle also conceivable to mix metal-organic and/or nonmetallic components into the first coating.

In this context, a nickel-phosphorus alloy which forms the basis of the first coating is a mixture of nickel and phosphorus in which the phosphorus content is, in particular, 1-15% by weight.

The expression "based on a nickel-phosphorus alloy" means that the nickel-phosphorus alloy forms the main constituent of the first coating. In addition to the nickel-phosphorus alloy and the additive component for improving the wear behavior of the doctor blade, other types of atoms and/or chemical compounds can preferably well be present in a smaller proportion than the nickel-phosphorus alloy in the first coating. The proportion of nickel-phosphorus alloy in the first coating is preferably at least 50% by weight, particularly preferably at least 70% by weight and very particularly preferably at least 80% by weight. The first coating ideally consists, apart from unavoidable impurities, exclusively of the nickel-phosphorus alloy and one or more additive components for improving the wear behavior of the doctor blade.

It has been found that the doctor blades of the invention have a high wear resistance and accordingly also a long life. Furthermore, the working edges of the doctor blade of the invention are optimally stabilized. This results in a sharply delineated contact zone between the doctor blade and the printing cylinder or the printing roller, which in turn allows extremely precise scraping-off of printing ink. The contact zone remains largely stable over the entire printing process.

In addition, it has been found that the doctor blades of the invention form significantly fewer streaks during the running-in phase of the printing process or otherwise cause effects which adversely affect the printing process. The doctor blade of the invention therefore makes it possible to achieve essentially constant printing quality during the entire printing process.

Furthermore, the doctor blades of the invention have extremely advantageous sliding properties on the printing cylinders or printing rollers normally used. This also reduces wear on the printing cylinders or printing rollers when the doctor blade of the invention is used for scraping-off.

In a preferred variant of the invention, the first coating is a nickel-phosphorus alloy deposited by an electroless method. Nickel-phosphorus alloys deposited by an electroless method, which are deposited without application of electric power or an external electric current, can also be referred to chemically as nickel. Such nickel-phosphorus alloys can be formed with particularly high contour accuracy relative to the working edge of the doctor blade or relative to the base element of the doctor blade and also with a very uniform layer thickness distribution. In this way, the first coating can optimally follow the contour of the working edge of the doctor blade or the base element, which contributes decisively to the quality of the doctor blade. Nickel-phosphorus alloys deposited by an electroless method also differ, in particular, in terms of the microstructure and elasticity from electrochemically deposited nickel-phosphorus alloys. Nickel-phosphorus alloys deposited by an electroless method are also compatible both with base elements composed of plastic and with base elements composed of metal, e.g. steel, and adhere particularly well to different base elements.

However, depending on the application, it can also be advantageous for the first coating to be an electrochemically deposited nickel-phosphorus alloy. In this case, the first coating is deposited electrochemically from an electrolyte bath onto the working edge and/or the base element of the doctor blade by means of an electric current. In the case of electrochemically deposited layers, the layer thickness, in particular, can be controlled very precisely, which is particularly advantageous in the case of thin layers.

The phosphorus content of the first coating is preferably 7-12% by weight. Such coatings have been found to be particularly useful in combination with the additive components for improving the wear behavior, since, in particular, a still higher wear resistance during the entire life of the doctor blade is obtained in this way. In addition, a phosphorus content of 7-12% by weight increases the corrosion resistance, the startup resistance and the inertness of the nickel-phosphorus alloy of the first coating. A phosphorus content of 7-12% by weight likewise has a positive effect on the sliding properties of the doctor blade and on the stability of the working edge, which makes particularly exact wiping-off or scraping-off of printing ink possible. Furthermore, very good adhesion to the base elements usually used for doctor blades, e.g. steel and/or plastics, is achieved at a phosphorus content of 7-12% by weight.

However, it is in principle also possible to provide a phosphorus content lower than 7% by weight or a phosphorus content greater than 12% by weight. However, the abovementioned positive effects can decrease as a result. On the other hand, such contents of phosphorus can also bring advantages in the case of specific additive components and/or embodiments of the coatings.

The first coating advantageously has a hardness of 750-1400 HV. This increases, in particular, the wear strength of the doctor blade. Hardnesses below 750 HV are also possible, but the wear resistance of the doctor blade decreases. At hardnesses greater than 1400 HV, the printing cylinder or the printing roller can be damaged under some circumstances, as a result of which the printing quality at best decreases.

The layer thickness of the first coating is advantageously 1-30 μm. The thickness of the first coating is more preferably 5-20 μm, particularly preferably 5-10 μm. Such thicknesses of the first coating offer optimal protection of the working edge of the doctor blade. In addition, first coatings having such dimensions have a high intrinsic stability, which effectively reduces the partial or complete delamination of the first coating, for example during scraping-off of printing ink from a printing cylinder.

Although thicknesses of less than 1 μm are possible, the wear resistance of the working edge or of the doctor blade decreases rapidly in this case. Thicknesses greater than 30 μm are also possible. However, these are generally less economical and can sometimes also have an adverse effect on the quality of the working edge. However, thicknesses of less than 1 μm or greater than 30 μm can be advantageous for specific fields of use of the doctor blade.

In a further advantageous variant, a second coating based on nickel is arranged on the first coating. A second coating based on nickel can serve, in particular, as protective layer for the first coating, as a result of which the wear resistance and stability of the working edge of the doctor blade can be increased further. In addition, a second coating can serve as stable matrix for further additives and have a positive effect on scraping-off by means of the doctor blade of the invention.

The expression "based on nickel" means that nickel forms the main component of the second coating. Other types of atoms and/or chemical compounds can perfectly well be present in a proportion smaller than that of nickel in addition to nickel in the second coating. The proportion of nickel in the second coating is preferably at least 50% by weight, particularly preferably at least 75% by weight and very particularly preferably at least 95% by weight. In a particularly useful embodiment, the second coating consists, except for unavoidable impurities, exclusively of nickel.

However, a second coating having a different composition, e.g. with another metal as main constituent, can in principle also be present, or the second coating can be dispensed with entirely.

In a preferred variant, the second coating is an electrochemically deposited coating based on nickel. Such coatings form a relatively soft protective layer for the first coating, as a result of which friction and wear in the contact zone region of the doctor blade can be reduced in many applications. The reduction in friction and the associated low resistance on scraping-off leads to a particularly high wear resistance and stability of the working edge of the doctor blade in many applications.

However, for other applications, it can also be advantageous to provide a coating deposited by an electroless method as second coating.

Furthermore, the second coating is preferably based on a further nickel-phosphorus alloy. As explained in connection with the first coating, the expression "based on a further nickel-phosphorus alloy" means that the further nickel-phosphorus alloy forms the main constituent of the second coating. Here, other types of atoms and/or chemical compounds can perfectly well be present in a proportion lower than that of the further nickel-phosphorus alloy in addition to the further nickel-phosphorus alloy in the second coating. The proportion of the further nickel-phosphorus alloy in the second coating is preferably at least 50% by weight, particularly preferably at least 70% by weight and very particularly preferably at least 80% by weight. Ideally, the second coating consists, except for unavoidable impurities, exclusively of the nickel-phosphorus alloy and at most one or more additive components to improve the wear behavior of the doctor blade.

In an advantageous variant, the second coating comprises an electrochemically deposited nickel-phosphorus alloy. This is particularly advantageous in combination with a first coating based on a nickel-phosphorus alloy deposited by an electroless method. In this case, the working edges are optimally stabilized by the combination of the first coating composed of a nickel-phosphorus alloy deposited by an electroless method and containing at least one additive component for improving the wear behavior of the doctor blade and the second coating based on the electrochemically deposited nickel-phosphorus alloy. This results in a particularly sharply delineated contact zone between the doctor blade and the printing cylinder or the printing roller, which in turn makes extremely precise scraping-off of printing ink possible. The contact zone remains largely stable over the entire printing process.

The further nickel-phosphorus alloy of the second coating has a phosphorus content of 12-15% in an advantageous variant. This is particularly the case when the second coating consists, except for unavoidable impurities, essentially exclusively of the further nickel-phosphorus alloy and has been electrochemically deposited.

Particularly when the second coating based on a further nickel-phosphorus alloy is present and in addition contains at least one further additive component for improving the wear behavior of the doctor blade, the phosphorus content of the second coating is advantageously lower than the phosphorus coating of the first coating. In other words, the phosphorus content of the further nickel-phosphorus alloy of the second coating is advantageously lower than the phosphorus content of the nickel-phosphorus alloy of the first coating. The combination of coatings having different phosphorus contents gives, in particular, greater wear protection for the working edge and at the same time effects further stabilization of the working edge. A phosphorus content of the further nickel-phosphorus alloy of the second coating of 6-9% by weight has been found to be particularly useful here.

The phosphorus content of the further nickel-phosphorus alloy of the second coating can in principle also be less than 6% or more than 9%. It is likewise possible in principle to provide a comparable phosphorus content in the first coating and in the second coating or establish a higher phosphorus content in the second coating than in the first coating. Depending on the intended use of the doctor blade, this can even be advantageous.

In particular, the layer thickness of the second coating is smaller than the layer thickness of the first coating and is advantageously 0.5-3 μm. Such layer thicknesses guarantee, in particular, a high intrinsic stability of the second coating and at the same time a good protective effect for the first coating, which is overall favorable for the stability of the working edge.

However, it is also possible, in the context of the invention, to realize a second coating having a layer thickness of less than 0.5 μm or more than 3 μm. It is also possible in principle to select a layer thickness of the second coating which is equal to or greater than the layer thickness of the first coating.

Whether a second coating is provided and what composition this has depends essentially on the intended use of the doctor blade. Here, for example, the material and the nature of the surface of the printing cylinder or the printing roller plays a critical role. A second coating comprising a nickel-phosphorus alloy is generally somewhat harder and more corrosion resistant compared to a coating based on nickel which is essentially free of phosphorus.

In the case of doctor blades having two or more coatings, the following different embodiments have, in particular, been found to be advantageous:

In a first preferred embodiment of the invention, the doctor blade of the invention comprises a first coating based on a nickel-phosphorus alloy deposited by an electroless method containing hard material particles dispersed therein and in particular a second coating based on electrochemically deposited nickel or a second coating based on an electrochemically deposited nickel-phosphorus alloy adjoining the first coating.

In a further advantageous embodiment, the doctor blade has a first coating based on a nickel-phosphorus alloy deposited by an electroless method containing a first type of hard material particles dispersed therein and a second coating based on a nickel-phosphorus alloy deposited by an electroless method containing a second type of hard material particles dispersed therein adjoining the first coating. The two types of hard material particles differ, in particular, in terms of their materials compositions and/or their particle sizes.

In addition, embodiments in which the doctor blade comprises a first coating based on a nickel-phosphorus alloy deposited by an electroless method containing hard material particles dispersed therein and a second coating based on a nickel-phosphorus alloy deposited by an electroless method containing lubricating particles, in particular particles of hexagonal BN, and adjoining the first coating have been found to be particularly useful. Here, two or more types of different hard material particles can also be present in the first coating.

The wear resistances of the doctor blade in these embodiments can optionally be improved further by mixing alloying components, e.g. metals such as W, into the first and/or second coating.

If the additive component comprises lubricants, in particular lubricating particles, the lubricants are preferably arranged in the outermost coating. In this way, a constant wear improvement is, in particular, achieved right from the beginning for the doctor blades of the invention.

In another preferred embodiment, the second coating comprises a primer layer which adjoins the first coating and is composed of pure nickel and a covering layer which is arranged on top of this and is composed of nickel and/or a nickel-phosphorus alloy. The primer layer of pure nickel preferably consists, except for unavoidable impurities, exclusively of nickel. The thickness of the primer layer is preferably 0.2-0.8 μm, in particular 0.4-0.6 μm. In particular, if the covering layer also consists of pure nickel, the covering layer advantageously additionally contains saccharin and/or a saccharin salt.

A second layer made up in this way has, firstly, good adhesion to the first coating and possibly also to the base element. In addition, the second coating has, in the case of a covering layer containing saccharin and/or a saccharin salt, a very even surface with a low surface roughness, which aids formation of a sharply delineated contact zone between doctor blade and printing cylinders or printing rollers.

However, it is in principle also possible to dispense with the formation of a primer layer and a covering layer for the second coating and provide only a single and essentially homogeneous layer.

Further details regarding the preferred additive components are given below.

The at least one additive component advantageously comprises hard material particles. In a preferred variant, the hard material particles comprise metal particles. Suitable metal particles are, for example, metal particles composed of W, Ti, Zr, Mo and/or steel. The metal particles can be used either alone, in combination with other metal particles and/or in combination with further additive components.

Metal particles composed of metallic molybdenum have been found to be particularly suitable. Doctor blades having a first coating and/or a second coating based on a nickel-phosphorus alloy containing metal particles of molybdenum dispersed therein have a very high wear resistance and accordingly also a long life. The working edges of such doctor blades have a sharply delineated contact zone between the doctor blade and the printing cylinder or the printing roller, which makes more precise scraping-off of printing ink possible. In a further preferred variant, the metal particles have a particle size of 1-2 μm and a proportion by volume in the first coating of 5-30%, particularly preferably 15-20%. In a very particularly preferred embodiment, the first coating consists, except for unavoidable impurities, exclusively of the nickel-phosphorus alloy and the metal particles, in particular molybdenum particles, dispersed therein.

In another advantageous embodiment, the hard material particles can comprise, instead of or in addition to the metal particles, metal oxides, metal carbides, metal nitrides, metal carbonitrides, metal borides, ceramics and/or intermetallic phases. These can be, for example, one, two or more representatives from the group consisting of $WSi_2$, $Al_2O_3$, $Cr_2O_3$, $Fe_2O_3$, $TiO_2$, $ZrO_2$, $ThO_2$, $SiO_2$, $CeO_2$, $BeO_2$, MgO, CdO, $UO_2$, SiC, TiC, WC, VC, ZrC, TaC, $Cr_3C_2$, $B_4C$, cubic BN, $ZrB_2$, TiN, $Si_3N_4$, $ZrB_2$, $TiB_2$. Although $B_4C$ (boron carbide) is in the strictest sense not a metal carbide, $B_4C$ will in the present context be included among metal carbides because of the similar materials properties.

Doctor blades having a first coating and/or a second coating based on a nickel-phosphorus alloy containing metal oxides, metal carbides, metal nitrides, metal carbonitrides, metal borides, ceramics and/or intermetallic phases dispersed therein have a high wear resistance and accordingly also a long life. Such hard material particles can be embedded extremely stably in the first coating and form a strong, stable bond with the nickel-phosphorus alloy of the first coating. In this way, the strength of the first coating can be improved overall and at the same time the working edges of such doctor blades display a sharply delineated contact zone between the doctor blade and the printing cylinder or the printing roller, which in turn makes more precise scraping-off of printing ink possible.

The following metal carbides and/or metal nitrides in particular have been found to be particularly useful: $B_4C$, cubic BN, TiC, WC and/or SiC. Among the metal oxides, $Al_2O_3$ is particularly advantageous.

However, the hard material particles do not necessarily have to be present in the form of metal particles, metal oxides, metal carbides, metal nitrides, metal carbonitrides, metal borides, ceramics and/or intermetallic phases. In principle, particles of other materials are also possible as hard material particles.

In a further advantageous variant, the hard material particles comprise diamond. Preference is given to using diamond having a monocrystalline and/or polycrystalline structure. Hard material particles composed of diamond have been found to be particularly advantageous in the doctor blades of the invention and bring about, in particular, a further improvement in the wear resistance and stabilization of the working edges of the doctor blade. This could be attributable, inter alia, to the high hardness and the chemical and mechanical stability of diamond. However, diamond is not to be confused with other forms of carbon such as graphite, glassy carbon, graphene or carbon black. These forms of carbon bring about the advantages according to the invention to only a limited extent or not at all.

As has been found, it is in principle also possible to use, instead of or in addition to hard material particles composed of diamond having a monocrystalline and/or polycrystalline structure, particles of amorphous diamond-like carbon ("DLC"). However, the amorphous diamond-like carbon advantageously has a high proportion of sp 3-hybridization so that a sufficient hardness is ensured. Depending on the intended use of the doctor blade, amorphous diamond-like carbon can even have advantages. In general, amorphous diamond-like carbon is also cheaper than diamond.

Hard material particles having a particle size in the range 5 nm-4 μm, in particular 0.9-2.5 μm, particularly preferably 1.4-2.1 μm, are particularly useful. The tribological properties of the doctor blades of the invention can be improved further by use of such particle sizes.

The particle size of the hard material particles is advantageously matched to the respective material of the hard material particles.

Thus, hard material particles in the form of metal particles particularly preferably have a particle size of 0.5-2.5 μm, in particular 1-2 μm. In the case of metal oxides, metal carbides, metal nitrides, metal carbonitrides, metal borides, ceramics and/or intermetallic phases, particle sizes of 1.0-2.5 μm, in particular 1.5-2.0 μm, have been found to be particularly advantageous.

Diamond particles as hard material particles advantageously have a particle size of 5 nm-1.1 μm. Furthermore, the particle size of diamond particles is preferably less than 300 nm. In particular, the particle size of diamond particles is in the range 100-200 nm. However, such particle sizes are not absolutely necessary. In the case of specific embodiments and/or uses of the doctor blades, diamond particles having particle sizes of 5-50 nm have also been found to be advantageous.

When hard material particles having particle sizes below 5 nm are used, the wear resistance, in particular, of the working edge of the doctor blade usually decreases, as a result of which the life of the doctor blade is shortened. In the case of particle sizes greater than 4 μm, it is possible for the doctor blade to have an increased surface roughness, which is generally undesirable. However, greater particle sizes can, in particular, also be suitable for specific uses and/or doctor blade structures.

The proportion by volume of the additive component for improving the wear properties is, particularly in the case of particulate additive components, preferably 5-30%, particularly preferably 15-20%. A significant improvement in respect of the wear properties and the stability of the working edge is achieved at such proportions.

Although lower proportions by volume are likewise possible, they generally display a less satisfactory improvement in the wear resistance. Excessively high proportions by volume of the additive component can likewise have an adverse effect on the properties of the doctor blade. However, proportions by volume above 30% may possibly also be suitable for specific applications.

In a further advantageous variant, the hard material particles comprise different particles of at least two different materials. As has been found, synergistic effects can be brought about thereby so as to improve the wear resistance and quality of the doctor blade to a far greater extent than expected. Furthermore, it can be advantageous for the hard material particles to comprise different particles having at least two different particle sizes.

The hard material particles particularly preferably comprise both SiC and diamond, with the particle size of the SiC more preferably being greater than the particle size of the diamond. In particular, the hard material particles comprise SiC having a particle size of 1.4-2.1 μm and diamond having a particle size of 5 nm-1.1 μm, preferably 200-300 nm.

However, it is also possible to select the particle sizes of SiC and diamond differently, so that, for example, the particle size of the diamond is equal to or greater than the particle size of the SiC. In addition, other combinations of hard material particles are also possible, with more than two, e.g. three, four or even more, different hard material particles also being able to be combined with one another.

In another preferred variant of the invention, the hard material particles comprise, for example, both SiC and cubic BN, with the particle size of the BN preferably corresponding approximately to the particle size of the SiC. The particle sizes of the SiC and of the cubic BN are particularly preferably about 1.4-2.1 μm.

Furthermore, it has been found to be advantageous for the additive component for improving the wear resistance to comprise lubricants, in particular lubricating particles. In this way, a lubricating effect can be additionally achieved during scraping-off, which reduces wear. Possible lubricants or lubricating particles are in principle substances which bring about a reduction in the sliding friction between doctor blade and printing cylinder and are, in particular, sufficiently stable for no damage to or fouling of the printing cylinder to occur.

Possibilities are, for example, polymeric thermoplastics, e.g. perfluoroalkoxyalkane and/or polytetrafluoroethylene, and also graphite, molybdenum disulfide and/or soft metals such as aluminum, copper and/or lead.

Hexagonal BN has been found to be particularly advantageous as lubricant, especially when used in particulate form. As has been found, the wear resistance of the doctor blade has been able to be improved in many applications using different printing cylinders by means of lubricants, in particular lubricating particles of hexagonal BN. This is, in particular, largely independent of the process parameters during scraping-off. In other words, hexagonal BN has been found to be an extremely versatile and effective lubricant.

A likewise well-suited lubricant is, for example, polytetrafluoroethylene (PTFE). Polytetrafluoroethylene is also preferably used in the form of lubricating particles.

Lubricating particles, in particular lubricating particles of hexagonal BN, advantageously have a particle size of 50 nm-1 μm, preferably 80-300 nm, more preferably 90-110 nm. This gives an optimal effect for many applications. However, other particle sizes can in principle also be suitable for specific applications.

In a particularly preferred embodiment, both lubricants, in particular lubricating particles, and hard material particles are present as additives for improving the wear resistance in the first coating and/or any second coating. Lubricating particles composed of hexagonal BN are ideally used in this case together with hard material particles composed of SiC.

In a further preferred embodiment of the invention, the additive component comprises an additional alloying component in the first coating and/or any second coating. In this way, the physical and chemical properties of the first and/or second coating can be matched further to the conditions prevailing during scraping-off. The properties of the coatings can be modified by means of the additional alloying component which, in particular, mixes completely with the first and/or second coating, without thereby affecting the homogeneity. As alloying component, it is possible to use, for example, metals. Examples of metals are, inter alia, Al, Cu, Pb, W, Ti, Zr and/or Zn. However, it is in principle also conceivable to mix metal-organic and/or nonmetallic components into the first and/or second coating.

The additional alloying component particularly preferably comprises a transition metal, in particular tungsten (W). The mixing in of W in particular can improve the wear resistance of the doctor blade. At the same time, when such doctor blades are used, a sharply delineated contact zone is obtained between working edge and printing cylinder, which makes particularly precise scraping-off of printing ink possible. However, for specific applications, it is also possible, for example, to use other alloying components.

The proportion of the alloying components in the first coating is advantageously 0.0001-12% by weight. The proportion of the alloying component is more preferably 0.5-5% by weight. In a further preferred embodiment, the proportion of the alloying component is 1-3% by weight.

It is also advantageous for both an additional alloying component and hard material particles to be present as additive component. The advantages according to the invention can be further improved in this way.

The additive component preferably comprises metallic W as alloying component and also SiC and diamond as hard material components. The particle size of the SiC is, in particular, greater than the particle size of the diamond. Particular preference is given to SiC being present in a particle size of 1.4-2.1 μm and diamond being present in a particle size of 10 nm-1.1 μm, preferably 200-300 nm.

However, other combinations of alloying components and hard material particles are in principle also possible.

In a preferred embodiment, the base element of the doctor blade comprises metal, in particular steel. Steel has from a mechanical point of view been found to be a particularly robust and suitable material for the doctor blades of the invention.

Preference is here given to at least one surface region of the base element present in the longitudinal direction to be completely covered all around with the first coating, the second coating and/or a further coating. In this way, at least the working edge, the upper side, the under side and the rear end face opposite the working edge of the base element are covered with at least one coating. The side faces of the base element perpendicular to the longitudinal direction can be uncoated. However, it is also within the scope of the invention for the second coating to cover the base element completely and on all sides, i.e. the side faces of the base element perpendicular to the longitudinal direction are also covered with one of the coatings. In this case, at least one coating surrounds the base element all around.

As a result of at least one of the surface regions present in the longitudinal direction of the base element being covered completely and all around with at least one coating, the essential regions of the base element which do not belong to the working edge are also provided with the second coating. This is particularly advantageous in order to protect the base element from water-based or slightly acidic printing inks and/or other liquids that come into contact with the doctor blade. Particularly in the case of base elements made of steel, optimal protection against rusting is in this way provided for the doctor blade. The constancy of the print quality during the printing process is thus improved further since the printing cylinder or the printing roller which is in contact with the doctor blade during the printing process is, for example, not contaminated by rust particles. Furthermore, the base element is protected as well as possible against rust formation by a second coating applied in the surface region, even during storage and/or transport.

However, it is also possible to use, for example, other metals or metal alloys instead of steel as base element.

In a further preferred embodiment, the base element comprises a plastics material. For specific applications, base elements made of plastics have sometimes been found to be more advantageous than base elements made of steel because of their different mechanical and chemical properties. Thus, some of the possible plastics have satisfactory chemical stability or inertness toward typical water-based and slightly acidic printing inks, as a result of which the base element does not have to be specially protected, as in the case of a base element made of steel.

Possible plastics materials are, for example, polymer materials. These can be, inter alia, thermoplastic, thermoset and/or elastomeric polymer materials. Suitable plastics are, for example, polyethylene, polypropylene, polyvinyl chloride, polystyrene, polyvinyl alcohol, polyethylene terephthalate, polyamide, polyacetal, polycarbonate, polyarylate, polyether ether ketone, polyimide, polyester, polytetrafluoroethylene and/or polyurethane. Composite structures having fibers for reinforcing the polymer matrix are also possible.

However, it is in principle also possible to use base elements which, for example, comprise both metal, in particular steel, and plastic. Base elements comprising other materials, e.g. ceramics and/or composites, may also be suitable for specific applications.

In an advantageous process for producing a doctor blade, in particular a doctor blade according to the invention, a first coating based on a nickel-phosphorus alloy is deposited on a working edge region formed in a longitudinal direction of a flat and elongated base element in a first step, where at least one additive component for improving the wear behavior of the doctor blade is mixed into the first coating.

The deposition of the first coating is, in particular, carried out by an electroless method and advantageously from an aqueous solution. Such deposition of the nickel-phosphorus alloy with mixing in of the additive component for improving the wear behavior makes it possible to produce a high-quality first coating which, in particular, has a high contour accuracy relative to the working edge of the doctor blade or relative to the base element of the doctor blade and also a very uniform layer thickness distribution. In other words, the electroless deposition forms an extremely uniform nickel-phosphorus alloy which contains a uniformly distributed additive component and optimally follows the contour of the working edge of the doctor blade or the base element, which contributes decisively to the quality of the doctor blade. Furthermore, a first coating which, in particular, is as compatible as possible with a second coating based on nickel to be applied to the first coating can be formed by the electroless deposition. This ensures satisfactory adhesion of the second coating to the first coating. To carry out the electroless coating, the working edge or optionally the entire base element of the doctor blade is dipped into a suitable electrolyte bath containing mixed in additive component and is coated in a manner known per se. The additive component mixed into the electrolyte bath is incorporated into the nickel-phosphorus alloy during the coating or deposition process and is essentially randomly distributed in the nickel-phosphorus alloy formed.

Owing to the electroless deposition of the nickel-phosphorus alloy, it is in principle also possible to use plastics as base elements for the doctor blade and provide them in a simple way with the first coating composed of the nickel-phosphorus alloy and the additive component.

However, it is in principle also possible to choose another deposition process. For example, the first coating can also be deposited electrochemically or by means of a gas-phase process, insofar as this appears suitable for the purpose.

The first coating is advantageously deposited in aqueous solution and preferably with air being blown in. As a result of the air being blown in, improved mixing, in particular, of the substances to be deposited is achieved, which has a positive effect on the quality of the first coating.

However, it is also possible to undertake other measures for improving mixing instead of or in addition to blowing in of air. This can be achieved, for example, by means of a mechanical stirrer.

In an advantageous variant, an alloying component which is preferably a metal and/or a metal salt is mixed in as additive component. Particular preference is given to using a tungsten salt as metal salt. The deposition of the first coating is advantageously carried out from an aqueous solution by an electroless method, preferably using sodium tungstate dihydrate having the empirical formula $Na_2WO_4.2H_2O$ as tungsten salt. If necessary, complexing agents known per se can be additionally introduced together with the tungsten salt.

The tungsten salt is advantageously present in a proportion of about 5-20 g/liter, preferably 10-12 g/liter, in the aqueous solution. This corresponds to a proportion of about 2.7-10.9 g/liter, in particular 5.5-6.5 g/liter, of the element tungsten in the aqueous solution.

As a result of the mixing in of the tungsten salt, the tungsten is, in particular, incorporated as alloying component into the nickel-phosphorus alloy. This makes it possible to obtain an extremely uniform nickel-phosphorus alloy which has improved wear resistance. In particular, the hardness and corrosion resistance of the nickel-phosphorus alloy can be improved by the incorporation of tungsten.

Other additive components such as hard material particles and/or lubricating particles can also be mixed in in addition to or instead of the alloying component.

The aqueous solution preferably has a pH of 8-9 during deposition. Such high pH values have surprisingly been found to have, in particular, a positive influence on the quality of the deposited coating during the deposition of alloying components. The wear resistance of the doctor blade can be significantly improved thereby and the contact region between the working edge of the doctor blade and the printing cylinder remains very constant during the entire life of the doctor blade. This in turn promotes precise scraping-off of printing ink.

If a second coating is provided, a second coating based on nickel is preferably deposited on at least a subregion of the first coating in a second step. The first coating is preferably completely covered by the second coating.

In a first advantageous variant, the second coating is deposited by an electrochemical method in the second step. This has, in particular, been found to be advantageous for second coatings without particulate additive components. Second coatings which consist, except for unavoidable impurities, exclusively of nickel or a nickel-phosphorus alloy are thus advantageously deposited electrochemically.

The electrochemical process which may be carried out in the second step can be carried out in a manner known per se. The regions of the doctor blade which are to be coated, in particular the working edge provided with the first coating, are in this case dipped, for example, into a suitable electrochemical electrolyte bath. The regions to be coated function as cathode, while, for example, a soluble consumable electrode comprising nickel serves as anode. However, it is in principle also possible, depending on the material to be deposited, to use insoluble anodes. Application of a suitable electric potential between cathode and anode results in flow of electric current through the electrochemical electrolyte bath, as a result of which elemental nickel or, for example, a nickel-phosphorus alloy deposits on the regions of the doctor blade which are to be coated and forms the second coating. The second coatings produced by the electrochemical process are pure and of high quality. In principle, an additive component for improving the wear resistance and/or other additives can be added to the electrolyte bath in order to improve the quality of the second coating further; these can optionally also be incorporated into the second coating.

The electrochemical deposition of a nickel-phosphorus alloy also has process engineering advantages over electroless deposition. Thus, the phosphorus content, for example, can be controlled very well and the deposition can be carried out at high deposition rates. Likewise, the electrochemical deposition of a nickel-phosphorus alloy has the advantage over the electrochemical deposition of nickel that insoluble anodes can also be used.

In a second advantageous variant, the deposition of the second coating is carried out by an electroless method, in particular from an aqueous solution. This procedure is advantageous particularly when particulate additive components, e.g. hard material particles and/or lubricating particles, are integrated into the second coating. In particular, a uniform distribution of the particulate additive components to be integrated into the second coating is achieved by electroless deposition.

A heat treatment for hardening the first and optionally also the second coating is advantageously carried out in a third step which is carried out after the first and/or second step. The heat treatment induces solid state reactions in the nickel-phosphorus alloys, which increase the hardness of the nickel-phosphorus alloys. Since the heat treatment is carried out only after deposition or application of a susceptible second coating, oxide formation, in particular, on the surface of the first coating is prevented. This firstly results in good adhesion between the first coating and any second coating present and secondly improves the overall uniformity of the doctor blade in the region of the working edge.

In principle, a heat treatment can also be omitted. However, this is at best at the cost of the wear resistance and life of the doctor blade produced according to the invention.

In particular, the coated base element is heated to a temperature of 100-500° C., particularly preferably a temperature in the range 170-300° C., during the heat treatment. These temperatures are, in particular, maintained over a hold time of 0.5-15 hours, preferably 0.5-8 hours. Such temperatures and hold times have been found to be optimal in order to achieve satisfactory hardnesses of the nickel-phosphorus alloys.

Temperatures of less than 100° C. are likewise possible. However, in this case very long and usually uneconomical hold times are necessary. Temperatures above 500° C. are in principle also possible, depending on the material of the base element, but the hardening process for the nickel-phosphorus alloy is more difficult to control in this case.

In another advantageous variant, a primer layer of nickel is firstly deposited at a pH of less than 1.5, in particular at a pH of less than 1, by means of an electrochemical process during the electrochemical process in the second step. In a further step, for example, a covering layer of nickel can subsequently be deposited using saccharin at a pH of 2-5, in particular at a pH of 3.4-3.9.

Owing to the acidic conditions, the surface of the working edge to be coated or of the first coating is chemically activated so that the primer layer forms an extremely stable bond to the working edge. The primer layer represents an optimal substrate for the covering layer to be deposited on top. Maintenance of a pH of 2-5 and the use of saccharin give an optimal covering layer having a smooth and even surface.

In principle, the primer layer and the covering layer can also be deposited under other conditions.

In particular, it is also possible to deposit a primer layer composed of nickel at a pH of less than 1.5, in particular at a pH of less than 1, by means of an electrochemical process and subsequently apply, for example, a covering layer in the form of a nickel-phosphorus alloy. The nickel-phosphorus alloy can in this case also contain, for example, an additive component for improving the wear behavior of the doctor blade.

Further advantageous embodiments and combinations of features of the invention can be derived from the following detailed description and the totality of the claims.

BRIEF DESCRIPTION OF THE ACCOMPANYING DRAWINGS

The drawings used for explaining the illustrative embodiment show:

Figure 7:
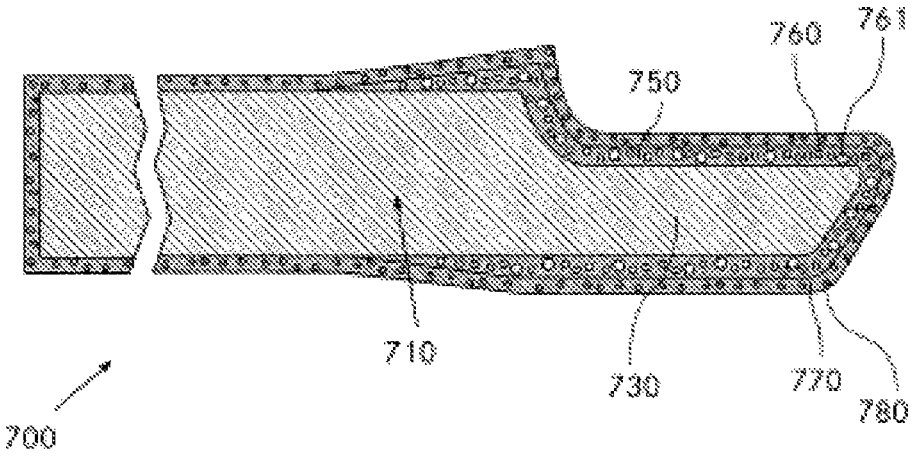
Figure 8:
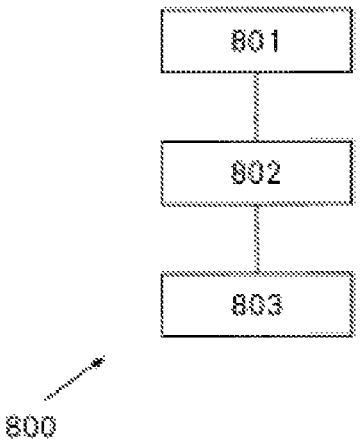

FIG. 7 is a cross section through a seventh lamellar doctor blade according to the invention which is coated in the region of a working edge with a first coating containing two different types of hard material particles dispersed therein and a second coating which is arranged on top of the first coating and contains lubricating particles dispersed in the second coating; and FIG. 8 is a schematic depiction of a process according to the invention for producing a doctor blade.

In the figures, identical parts are basically provided with the same reference numerals.

DETAILED DESCRIPTION OF THE PREFERRED EMBODIMENTS

Figure 1:
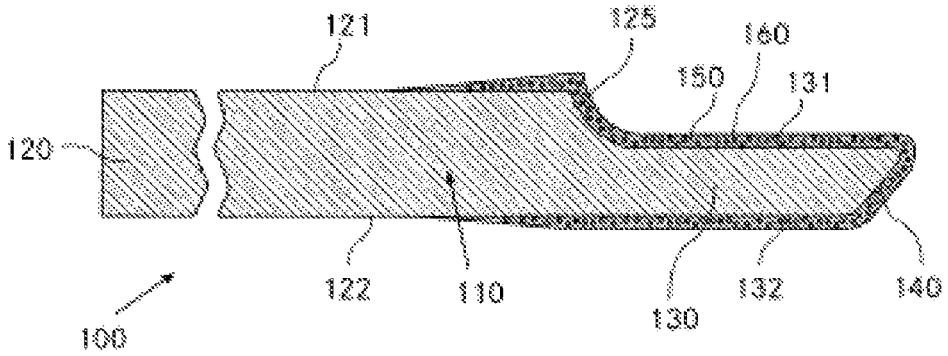
FIG. 1 is a cross section through a first lamellar doctor blade according to the invention, where a working edge of the lamellar doctor blade is coated with a nickel-phosphorus alloy and hard material particles dispersed therein.

FIG. 1 depicts a lamellar doctor blade 100 according to the invention in cross section. The lamellar doctor blade 100 comprises a base element 110 made of steel which on the left-hand side in FIG. 1 has a rear region 120 having an essentially rectangular cross section. The rear region 120 is provided as a fastening region in order to hold the lamellar doctor blade in, for example, an appropriate holding device of a printing machine. The doctor blade thickness measured from the upper side 121 to the under side 122 of the rear region is about 0.2 mm. The length of the base element 110 or the lamellar doctor blade 100 measured perpendicular to the plane of the plate is, for example, 1000 mm.

On the right-hand side in FIG. 1, the base element 110 is tapered stepwise from the upper side 121 of the rear region 120 to form a working edge 130. An upper side 131 of the working edge 130 lies on a plane below the plane of the upper side 121 of the rear region 120 but is essentially parallel to the upper side 121 of the rear region 120. Between the rear region 120 and the working edge 130, there is a concave transition region 125. The under side 122 of the rear region 120 and the under side 132 of the working edge 130 are in the same plane which is parallel to the upper side 121 of the rear region 120 and parallel to the upper side 131 of the working edge 130. The width of the base element 110, measured from the end of the rear region to the front face 140 of the working edge 130 is, for example, 40 mm. The thickness of the working region 130, measured from the upper side 131 to the under side 132 of the working region, is, for example, 0.060-0.150 mm, which corresponds approximately to half the thickness of the doctor blade in the rear region 120. The width of the working region 130, measured from the upper side 131 of the working region 130 from the front face 140 to the transition region 125, is, for example, 0.8-5 mm.

A free front face 140 of the free end of the working edge 130 runs obliquely downward from the upper side 131 of the working edge 130 to the under side 132 of the working edge 130. The front face 140 makes an angle of about 45° or 135° to the upper side 131 of the working edge 130 or to the under side 132 of the working edge 130, respectively. An upper transition region between the upper side 131 and the front face 140 of the working edge 130 is rounded. Likewise, a lower transition region between the front face 140 and the under side 132 of the working edge 130 is rounded.

The working edge 130 of the lamellar doctor blade 100 is also surrounded by a first coating 150. The first coating 150 completely covers the upper side 131 of the working edge 130, the transition region 125 and an adjoining subregion of the upper side 121 of the rear region 120 of the base element 110. Likewise, the first coating 150 covers the front face 140, the under side 132 of the working edge 130 and a subregion of the under side 122 of the rear region 120 of the base element 110 which adjoins the under side of the working edge 130.

The first coating 150 consists, for example, of a nickel-phosphorus alloy having a phosphorus content of 9% by weight. Hard material particles 160, e.g. particles of silicon carbide (SiC), are dispersed therein. The proportion by volume of the hard material particles 160 is, for example, 16% and the average particle size of the hard material particles 160 is about 1.6 μm. The layer thickness of the first coating 150 in the region of the working edge 130 is, for example, 15 μm, while the hardness is, for example, 1200 HV. The layer thickness of the first coating 150 decreases continuously in the region of the upper side 121 and the under side 122 of the rear region 120, so that the first coating 150 runs to its end in the form of a wedge in a direction away from the working edge 130.

Figure 2:
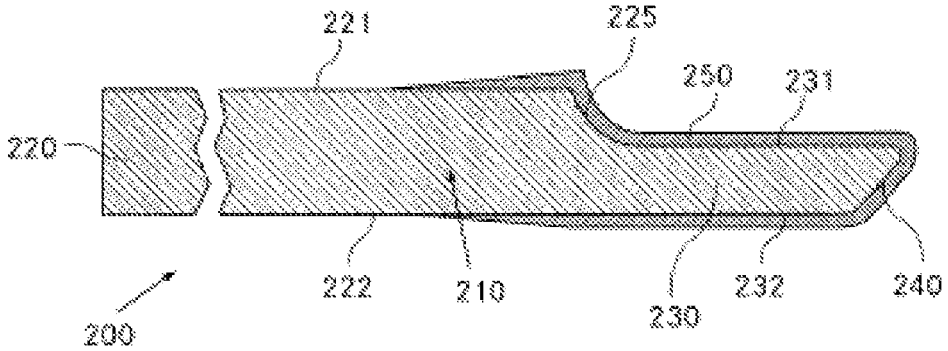
FIG. 2 is a cross section through a second lamellar doctor blade according to the invention, where a working edge of the lamellar doctor blade is coated with a nickel-phosphorus tungsten alloy.

FIG. 2 shows a second lamellar doctor blade 200 according to the invention in cross section. The second lamellar doctor blade 200 has a base element 210 having a rear region 220 and a working edge region 230 and has essentially the same construction as the first lamellar doctor blade 100 from FIG. 1. The upper side 231 of the working edge 230, the transition region 225 and an adjoining subregion of the upper side 221 of the rear region 220 of the base element 210 and also the front face 240, the under side 232 of the working edge 230 and a subregion of the under side 222 of the rear region 220 of the base element 210 adjoining the under side 232 of the working edge 230 are likewise coated with a coating 250 in the case of the second lamellar doctor blade 200.

The second coating consists of a nickel-phosphorus alloy containing a mixed-in alloying component in the form of tungsten (W). The phosphorus content is, for example, 10% by weight and the proportion of tungsten is, for example, 5% by weight, in each case based on the total weight of the coating 250. The layer thickness of the coating 250 in the region of the working edge 130 is, for example, 15 μm, while the hardness is, for example, 1200 HV.

Figure 3:
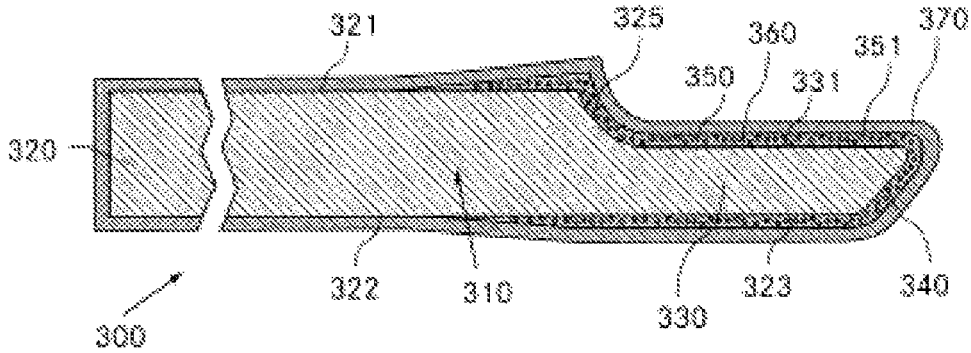
FIG. 3 is a cross section through a third lamellar doctor blade according to the invention which is coated in the region of the working edge with a first coating containing hard material particles dispersed therein and a second coating which is composed of pure nickel and is arranged on the first coating and completely surrounds the doctor blade.

FIG. 3 shows a third lamellar doctor blade 300 according to the invention in cross section. The third doctor blade 300 has a base element 310 which in the region of the working edge 330 is coated with a first coating 350 in the same way as the first doctor blade in FIG. 1. Correspondingly, the upper side 331 of the working edge 330, the transition region 325 and an adjoining subregion of the upper side 321 of the rear region 320 of the base element 310 and also the front face 340, the under side 332 of the working edge 330 and a subregion of the underside 322 of the rear region 320 of the base element 310 adjoining the under side 332 of the working edge 330 are coated with the coating 350.

The first coating 350 of the third lamellar doctor blade 300 has the same composition and structure as the coating 150 of the first lamellar doctor blade 100 and contains corresponding hard material particles 360, e.g. particles of silicon carbide.

In addition, the third lamellar doctor blade has a second coating 370 which completely surrounds the lamellar doctor blade 300. In other words, the second coating 370 completely covers both the first coating 350 and the upper side 321 and also the under side 322 of the rear region 320 of the base element 310.

The second coating 370 is, for example, formed by an electrochemically deposited nickel layer having a thickness of, for example, about 2 μm. The second coating 370 consists, except for unavoidable impurities, exclusively of nickel in the present case.

Figure 4:
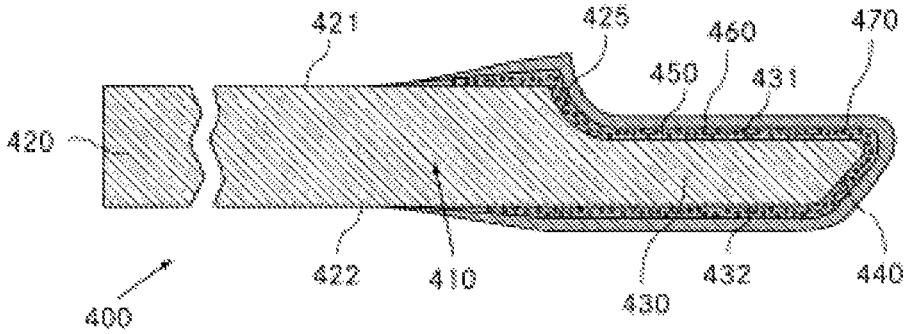
FIG. 4 is a variant of the doctor blade of FIG. 3, where the second coating is present only in the region of the first coating.

FIG. 4 shows a fourth lamellar doctor blade 400 in cross section. The fourth lamellar doctor blade 400 has essentially the same construction as the third lamellar doctor blade from FIG. 3. However, in contrast to the third doctor blade 300, the fourth doctor blade 400 has a second coating 470 which only covers the first coating 450. The second coating 470 thus surrounds only the upper side 431 of the working edge 430, the transition region 425 and an adjoining subregion of the upper side 421 of the rear region 420 of the base element 410 and also the front face 440, the under side 432 of the working edge 430 and a subregion of the under side 422 of the rear region 420 of the base element 410 adjoining the under side 432 of the working edge 430. The rear region 420 of the base element 410 is accordingly bare and covered neither with the first coating 450 nor with the second coating 470.

In the region of the upper side 421 and the under side 422 of the rear region 420, the layer thickness of the second coating 470 decreases continuously, so that the second coating 470 runs to its end in the form of a wedge in a direction away from the working edge 430.

Figure 5:
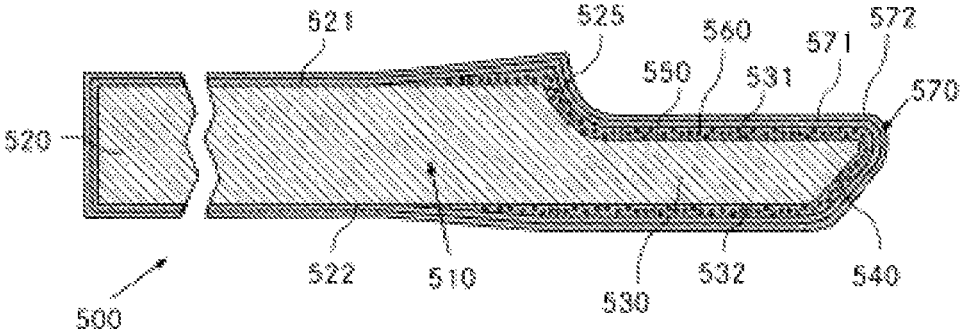
FIG. 5 is a cross section through a fifth lamellar doctor blade according to the invention which is coated in the region of the working edge with a first coating containing hard material particles dispersed therein and a two-layer second coating of nickel arranged thereon.

FIG. 5 depicts a fifth lamellar doctor blade 500 according to the invention in cross section. The base element 510 having the rear end 520 and the working edge 530 has essentially the same construction as the lamellar doctor blade 300 from FIG. 3. The fifth doctor blade 500 likewise has a first coating 550 which is configured in the same way as the coating 350 of the third doctor blade 300. Correspondingly, the first coating 550 of the fifth doctor blade 500 covers the upper side 531 of the working edge 530, the transition region 525 and an adjoining subregion of the upper side 521 of the rear region 520 of the base element 510 and also the front face 540, the under side 532 of the working edge 530 and a subregion of the under side 522 of the rear region 520 of the base element 510 adjoining the under side 532 of the working edge 530.

As in the case of the third lamellar doctor blade 300, the fifth doctor blade 500 also has a second coating 570 which completely surrounds the lamellar doctor blade 500, so that the second coating 570 completely surrounds the first coating 550, the upper side 521 and also the under side 522 of the rear region 520 of the base element 410. In contrast to the second coating 370 of the third doctor blade, the second coating 570 of the fifth doctor blade 500 has a two-layer structure. The second coating 570 has a primer layer 571 which has been applied electrochemically directly onto the first coating 550 and the rear region 520 of the base element 510 and consists, except for unavoidable impurities, exclusively of pure nickel. The thickness of the primer layer 571 is, for example, about 0.5 μm. The covering layer 572 applied on top of the primer layer 571 likewise consists of electrochemically deposited pure nickel which, however, is additionally admixed with saccharin. The layer thickness of the second coating 570, i.e. the layer thickness of the primer layer 571 and the layer thickness of the covering layer 572, in the region of the working edge 530 is, for example, about 4 μm, while the layer thickness in the rear region 520 is, for example, about 2 μm.

Figure 6:
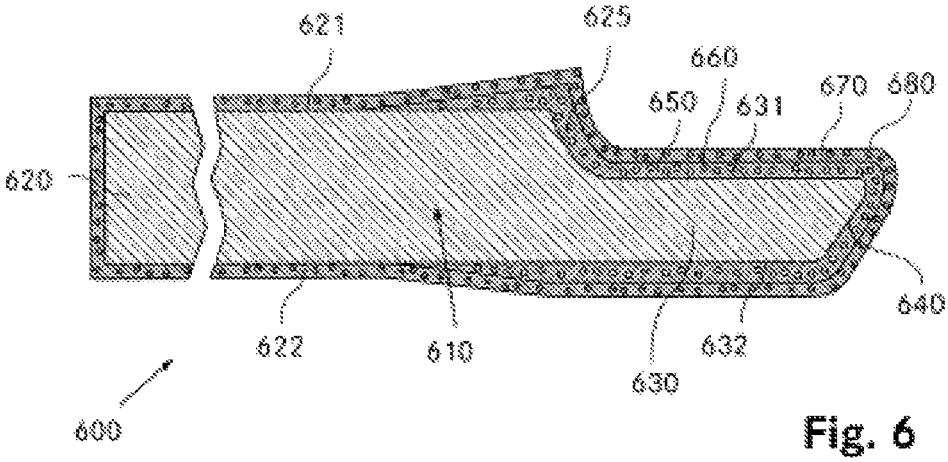
FIG. 6 is a cross section through a sixth lamellar doctor blade according to the invention which is coated in the region of a working edge with a first coating containing hard material particles dispersed therein and a second coating which is arranged on top of the first coating and contains lubricating particles of hexagonal boron nitride dispersed in the second coating.

FIG. 6 shows a sixth lamellar doctor blade 600 in cross section. The base element 610 having the rear region 620 and the working edge 630 provided with a first coating 650 have essentially the same construction as the third doctor blade 300 from FIG. 3. In contrast to the third doctor blade 300 from FIG. 2, the second coating 670, which completely surrounds the sixth doctor blade 600, consists of a nickel-phosphorus alloy which has been deposited by an electroless method and contains lubricating particles 680 of hexagonal boron nitride (hex-BN) dispersed therein. The phosphorus content of the second coating 670 is, for example, 7% by weight, while the thickness of the second coating is about 2 μm. The lubricating particles 680 have a particle size of about 100 nm and a proportion by volume of about 17%.

FIG. 7 shows a seventh lamellar doctor blade 700 which represents a variant of the sixth doctor blade 600 from FIG. 6, in cross section. The arrangement of the first coating 750 and the second coating 770 on the base element 710 of the seventh doctor blade 700 is essentially the same as in the sixth doctor blade 600 from FIG. 6. However, the sixth doctor blade 600 and the seventh doctor blade 700 differ in terms of the composition of the coatings.

The first coating 750 of the seventh doctor blade 700 which essentially surrounds the working edge 730, is based on a nickel-phosphorus alloy which has been deposited by an electroless method and contains a first additive component in the form of mixed-in tungsten (W). In other words, the first coating 750 is thus based on a nickel-phosphorus-tungsten alloy. The layer thickness of the first coating 750 in the region of the working edge 730 is, for example, about 12 μm and the phosphorus content is about 12% by weight. In addition, further additive components in the form of a first hard material component 760 and a second hard material component 761 are dispersed in the first coating 750. The first hard material component 760 is, for example, diamond particles having a particle size of, for example, 100-200 nm and a proportion by volume of about 10%. The second hard material component consists, for example, of silicon carbide (SiC) having a particle size of 1.5-2.0 μm and a proportion by volume of about 10%. The particle size of the second hard material component 761 (SiC) is thus greater than the particle size of the first hard material component 760 (diamond). The hardness of the first coating 750 is about 1300 HV.

The second coating 770, which completely surrounds the seventh doctor blade 700, is based, for example, on a nickel-phosphorus alloy which has been deposited by an electroless method and contains lubricating particles 780 of hexagonal BN (hex-BN) dispersed therein. The phosphorus content of the second coating is about 6% by weight while the layer thickness is about 2 μm and the proportion by volume of the lubricating particles 780 is about 18%. The particle size of the lubricating particles 780 is about 100 nm. The phosphorus content of the nickel-phosphorus alloy of the second coating 770 is thus lower than the phosphorus content of the nickel-phosphorus alloy of the first coating 750.

The above-described lamellar doctor blades shown in FIGS. 1-7 are merely illustrative examples of many embodiments which can be realized. Further specific embodiments are shown in Table 1 below. To aid understanding of the table: the abbreviation "Chem. Ni—P" is a nickel-phosphorus alloy deposited chemically or in an electroless manner. Correspondingly, the abbreviation "Elect." means electrochemically deposited and "Elect. Ni—P" refers to an electrochemically deposited nickel-phosphorus alloy. "P content" is the phosphorus content of a nickel-phosphorus alloy.

TABLE 1

| | 1st coating | | 2nd coating | |
|---|---|---|---|---|
| No. | Basis<br>P content<br>Thickness | Additive component<br>Particle size<br>Proportion by volume | Basis<br>P content<br>Thickness | Additive component<br>Particle size<br>Proportion by volume |
| A<br>(FIG. 1) | Chem. Ni—P<br>9%<br>15 μm | SiC<br>1.6 μm<br>16% | none | none |
| B | Chem. Ni—P<br>12%<br>25 μm | TiC<br>1.9 μm<br>20% | none | none |
| C | Chem. Ni—P<br>8%<br>25 μm | WC<br>1.8 μm<br>15% | none | none |

TABLE 1-continued

| No. | 1st coating Basis P content Thickness | 1st coating Additive component Particle size Proportion by volume | 2nd coating Basis P content Thickness | 2nd coating Additive component Particle size Proportion by volume |
|---|---|---|---|---|
| D | Chem. Ni—P 8% 25 μm | cubic BN 1.8 μm 15% | none | none |
| E | Chem. Ni—P 8% 25 μm | cubic $B_4C$ 1.8 μm 15% | none | none |
| F | Chem. Ni—P 10% 10 μm | molybdenum (particle) 1.5 μm 17% | none | none |
| G | Chem. Ni—P 8% 20 μm | hexagonal BN 1.8 μm 15% | none | none |
| H (FIG. 2) | Chem. Ni—P 10% 15 μm | Tungsten none, since alloy 5% | none | none |
| I (FIG. 3) | Chem. Ni—P 9% 15 μm | SiC 1.6 μm 16% | Elect. nickel 0% 2 μm | |
| J | Chem. Ni—P 9% 15 μm | $Al_2O_3$ 1.6 μm 16% | Elect. nickel 0% 2 μm | none |
| K (FIG. 5) | Chem. Ni—P 9% 15 μm | SiC 1.6 μm 16% | Elect. nickel (primer layer/ covering layer containing saccharin) 0% 2-4 μm | none |
| L | Chem. Ni—P 9% 15 μm | SiC 1.6 μm 16% | Elect. Ni—P 13% 2 μm | none |
| M | Chem. Ni—P 9% 15 μm | $Al_2O_3$ 1.6 μm 16% | Elect. Ni—P 13% 2 μm | none |
| N (FIG. 6) | Chem. Ni—P 9% 15 μm | SiC 1.6 μm 16% | Chem. Ni—P 7% 2 μm | Hexagonal BN 100 nm 17% |
| O | Chem. Ni—P 9% 15 μm | SiC 1.6 μm 16% | Chem. Ni—P 6% 2 μm | cubic BN 1.5 μm 18% |
| P (FIG. 7) | Chem. Ni—P 12% 12 μm | Tungsten none, since alloy 5% SiC 1.5 μm 10% Diamond 150 nm 10% | Chem. Ni—P 6% 2 μm | hexagonal BN 100 nm 18% |

The embodiment denoted by "A" in the table corresponds to the first lamellar doctor blade 100 depicted in FIG. 1. The embodiments "B"-"G" refer to the indicated and sometimes different additive components, particle sizes, proportion by volume and/or layer thicknesses of a structure analogous to the lamellar doctor blade 100.

The embodiment denoted by "H" corresponds to the second lamellar doctor blade 200 of FIG. 2, while the embodiment denoted by "I" corresponds to the third lamellar doctor blade 300 of FIG. 3. The embodiment "J" is of essentially the same construction as the third lamellar doctor blade 300 of FIG. 3 except for the different additive component in the first coating.

The lamellar doctor blade 500 depicted in FIG. 5 is denoted as embodiment "K" in the table and accordingly has a two-layer electrochemically deposited second coating based on nickel. The embodiments "L" and "M" represent variants of the embodiment "K" which instead of the second coating based on nickel have a second coating in the form of an electrochemically deposited nickel-phosphorus alloy.

The embodiment "N" corresponds to the sixth lamellar doctor blade 600 depicted in FIG. 6. Embodiment "O" differs from the embodiment "N" in that, in particular, it contains cubic boron nitrode (cub-BN) instead of hexagonal boron nitride (hex-BN) in the second coating. It should be noted that the particle size of the cubic boron nitride is substantially greater than the particle size of the hexagonal boron nitride.

Finally, embodiment "P" corresponds to the seventh lamellar doctor blade 700 in FIG. 7.

FIG. 8 illustrates a process 800 for producing a lamellar doctor blade as depicted, for example, in FIG. 5. Here, in a first step 801, the working edge 530 of the base element 510 to be coated with the nickel-phosphorus alloy or the first coating 550 is, for example, dipped into a suitable aqueous electrolyte bath known per se containing hard material particles 560 suspended therein, with nickel ions from a nickel salt, e.g. nickel sulfate, being reduced to elemental nickel by means of a reducing agent, e.g. sodium hypophosphite, in an aqueous environment and being deposited on the working edge 530 to form a nickel-phosphorus alloy and at the same time embed the hard material particles 560. This occurs without application of an electric potential and completely without an external electric current under highly acidic conditions (pH 4-6.5) and at elevated temperatures of, for example, 70-95° C.

In a second step 802, for example, a first electrochemical electrolyte bath based on water containing nickel chloride and hydrochloric acid and having a pH of about 1 is initially charged. The base element 510 with the first coating 550 applied in the first step is immersed completely in the electrolyte bath and a primer layer 571 of the second coating 570 is deposited in a manner known per se by means of an external electric current. A covering layer 572 is subsequently deposited in a manner known per se in a second electrochemical electrolyte bath based on water containing nickel, nickel sulfate, nickel chloride, boric acid and saccharin at a pH of 3.7.

In a third step 803, the base element 510 provided with the first coating 550 and the second coating 570 is subjected to a heat treatment at a temperature of 300° C. for, for example, two hours. Finally, the finished lamellar doctor blade 500 is cooled and is thus ready to use.

If a doctor blade without a second coating is produced, the second step 802 is omitted and the third step is correspondingly carried out without the second coating. To produce a doctor blade which has a second coating based on a nickel-phosphorus alloy deposited by an electroless method, coating analogous to the first step 801 is carried out in the second step 802. If tungsten (W) is provided as additive component for improving the wear behavior, deposition of the respective coating as per the first step 801 follows, in particular at a pH of 8-9.

As tests have shown, the lamellar doctor blades 100, 200, 300, 400, 500, 600, 700 depicted in FIGS. 1-7 and the lamellar doctor blades additionally shown in Table 1 have a very high wear resistance and stability and make extremely precise scraping-off, in particular of printing ink, possible. The latter is the case over the entire life of the doctor blades.

For comparison, a base element identical to that of the lamellar doctor blade 100 from FIG. 1 was, in a first comparative experiment, provided only with a first coating composed of a pure nickel-phosphorus alloy in the region of the working edge, with the additive component for increasing the wear resistance in the form of the hard material particles of SiC being dispensed with. As has been found, such doctor blades have a significantly poorer wear resistance and stability than the doctor blades shown in FIGS. 1-7.

In further tests, the additive components for improving the wear behavior were in each case left out in the lamellar doctor blades 300, 500, 600, 700 from FIGS. 3, 5, 6 and 7. Such doctor blades, too, have a significantly poorer wear resistance than the doctor blades shown in FIGS. 3, 5, 6 and 7.

The above-described embodiments and the production process are merely illustrative examples which can be modified as desired within the scope of the invention.

Thus, the base elements 110, 210, 310, 410, 510, 610, 710 of the doctor blades in FIGS. 1-7 can also be made of a different material, e.g. stainless steel or a carbon steel. In this case, it can be advantageous, for economic reasons, to apply the second coating only in the region of the working edges 130, 230, 330, 430, 530, 630, 730 in order to reduce the consumption of material for the coating. However, the base elements of the doctor blades in FIGS. 1-7 can in principle also consist of a nonmetallic material, e.g. plastics. This can, in particular, be advantageous for applications in flexographic printing.

It is also possible to use base elements having a different shape than the base elements shown in FIGS. 1-7. In particular, the base elements can have a wedge-shaped working edge or an untapered cross section having a rounded working edge. The free front faces 140, 240, 340, 440, 540, 640, 740 of the working edges 130, 230, 330, 430, 530, 630, 730 can, for example, also be completely rounded.

Furthermore, the doctor blades of the invention in FIGS. 1-7 can also have different dimensions. Thus, for example, the thicknesses of the working regions 130, 230, 330, 430, 530, 630, 730, measured from the respective upper sides 131 . . . 731 to the respective under sides 132, 232, . . . 732, can vary in the range of, for example, 0.040-0.200 mm.

The coatings of the doctor blades in FIGS. 1-7 can likewise contain further alloying components and/or additional materials such as metal atoms, nonmetal atoms, inorganic compounds and/or organic compounds. The additional materials can also be particulate.

All of the doctor blades shown in FIGS. 1-7 can, for example, be coated with further coatings. The further coatings can be present in the region of the working edges and/or the rear regions and, for example, improve the wear resistance of the working edges and/or protect the rear region from attack by aggressive chemicals. In principle, these can also be coatings composed of plastics.

In the case of the doctor blade 200 from FIG. 2, it is also possible to apply a second coating to the existing first coating 250 and introduce additive components for improving the wear behavior, e.g. particulate additive components, into the second coating.

In summary, it can be said that novel doctor blades which display extremely good wear resistance and allow uniform and streak-free scraping-off of printing ink over the entire life have been provided. At the same time, the doctor blades of the invention can be realized in a variety of embodiments, so that they can be specifically matched to specific uses.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. A doctor blade for scraping printing ink from a surface of a printing plate, which comprises a flat and elongated base element having a working edge region formed in a longitudinal direction, where at least the working edge region is coated with at least a first coating based on a nickel-phosphorus alloy, wherein said at least a first coating contains at least one additive component for improving the wear of the doctor blade, said at least one additive component comprising hard material particles, wherein the hard material particles comprise both SiC and diamond, with a particle size of the SiC being greater than a particle size of the diamond;

wherein said at least a first coating comprises said hard material particles dispersed therein.

2. The doctor blade as claimed in claim 1, wherein the first coating comprises a nickel-phosphorus alloy deposited by an electroless method.

3. The doctor blade as claimed in claim 2, wherein the phosphorus content of the first coating is 7-12% by weight.

4. The doctor blade as claimed in claim 1, wherein the first coating has a hardness of 750-1400 HV.

5. The doctor blade as claimed in claim 4, wherein thickness of the first coating is between 1-30 μm.

6. The doctor blade as claimed in claim 1, wherein a second coating based on nickel is present, where the second coating has been applied directly on top of the first coating.

7. The doctor blade as claimed in claim 6, wherein the second coating is an electrochemically deposited coating.

8. The doctor blade as claimed in claim 6, wherein the second coating is based on a nickel-phosphorus alloy.

9. The doctor blade as claimed in claim 8, wherein the nickel-phosphorus alloy of the second coating has a phosphorus content of 12-15%.

10. The doctor blade as claimed in claim 6, wherein the layer thickness of the second coating is 0.5-3 μm.

11. The doctor blade as claimed in claim 1, wherein the hard material particles comprise metal particles of metallic molybdenum.

12. The doctor blade as claimed in claim 1, wherein the hard material particles comprise metal carbides, metal nitrides and/or metal carbonitrides.

13. The doctor blade as claimed in claim 1, wherein the hard material particles contain $B_4C$, cubic BN, TiC, WC and/or SiC.

14. The doctor blade as claimed in claim 1, wherein the hard material particles contain metal oxides.

15. The doctor blade as claimed in claim 1, wherein the hard material particles comprise both SiC and cubic BN, with the particle size of the BN corresponding approximately to the particle size of the SiC and the particle sizes of the SiC and of the cubic BN being between 1.4-2.1 μm.

16. The doctor blade as claimed in claim 1, wherein the additive component comprises lubricating particles.

17. The doctor blade as claimed in claim 16, wherein the lubricating particles comprise hexagonal BN and/or polytetrafluoroethylene.

18. The doctor blade as claimed in claim 17, wherein the lubricating particles comprise hexagonal BN having a particle size of between 50 nm-1 μm.

19. The doctor blade as claimed in claim 1, wherein the additive component comprises an additional alloying component.

20. The doctor blade as claimed in claim 19, wherein the additional alloying component comprises tungsten.

21. The doctor blade as claimed in claim 1, wherein the base element consists of steel.

22. The doctor blade as claimed in claim 1, wherein the base element consists of plastic.

23. A process for producing a doctor blade, for scraping printing ink from a surface of a printing plate, wherein the doctor blade comprises a flat and elongated base element having a working edge region formed in a longitudinal direction, where at least the working edge region is coated with at least a first coating based on a nickel-phosphorus alloy, wherein said at least a first coating contains at least one additive component for improving the wear of the doctor blade, said at least one additive component comprising hard material particles, wherein the hard material particles comprise both SiC and diamond, with a particle size of the SiC being greater than a particle size of the diamond;

said process comprising the steps of:

mixing said at least one additive component into said at least a first coating;

substantially simultaneously depositing said at least a first coating based on a nickel-phosphorus alloy and said at least one additive component on a working edge region of the doctor blade formed in a longitudinal direction of a flat and elongated base element;

said at least one additive component comprising hard material particles, wherein said hard material particles comprise both SiC and diamond, with the particle size of the SiC being greater than the particle size of the diamond.

24. The process as claimed in claim 23, wherein the deposition of said at least a first coating is carried out in aqueous solution and with blowing in of air.

25. The process as claimed in claim 24, wherein an alloying component which is a tungsten salt is mixed in as additive component.

26. The process as claimed in claim 24, wherein the aqueous solution in the deposition has a pH of 8-9.

27. The process as claimed in claim 23, wherein, in a second step (802), a second coating based on nickel is deposited at least on said at least a first coating.

28. The doctor blade as claimed in claim 1, wherein the hard material particles have particle sizes in the range between 5 nm-4 μm.

29. The doctor blade as claimed in claim 1, wherein the hard material particles comprise SiC having a particle size of 1.4-2.1 μm and diamond having a particle size of 10 nm-1.1 μm.

30. The doctor blade as claimed in claim 5, wherein thickness of said at least a first coating is between 5-10 μm.

31. The doctor blade as claimed in claim 17, wherein the lubricating particles comprise hexagonal BN having a particle size of between 80-300 nm.

32. The doctor blade as claimed in claim 17, wherein the lubricating particles comprise hexagonal BN having a particle size of between 90-110 nm.

33. The doctor blade as claimed in claim 1, wherein the hard material particles have particle sizes in the range between 0.9-2.5 μm.

34. The doctor blade as claimed in claim 1, wherein the hard material particles have particle sizes in the range between 1.4-2.1 μm.

35. The doctor blade as claimed in claim 1, wherein the hard material particles contain aluminium oxide ($Al_2O_3$).

* * * * *